United States Patent [19]

Chiang

[11] 4,239,269

[45] Dec. 16, 1980

[54] LUGGAGE LOCK

[76] Inventor: Chih-Chang Chiang, 2nd Floor, 38, Nanking West Rd., Taipei, Taiwan

[21] Appl. No.: 244

[22] Filed: Jan. 2, 1979

[51] Int. Cl.[3] ..... E05C 1/10

[52] U.S. Cl. ..... 292/175; 292/DIG. 38; 292/DIG. 48

[58] Field of Search ..... 292/175, 302, DIG. 38, 292/DIG. 48, 163, 164, 174

[56] References Cited

U.S. PATENT DOCUMENTS

| | | | |
|---|---|---|---|
| 1,178,736 | 4/1916 | La Barre | 292/175 |
| 1,507,110 | 9/1924 | Duncan | 292/175 X |
| 3,671,065 | 6/1972 | Bingham | 292/175 |
| 3,918,752 | 11/1975 | Leone et al. | 292/302 |

FOREIGN PATENT DOCUMENTS

| | | | |
|---|---|---|---|
| 1083426 | 6/1954 | France | 292/302 |
| 92409 | 3/1938 | Sweden | 292/302 |

*Primary Examiner*—Richard E. Moore
*Attorney, Agent, or Firm*—J. Harold Nissen

[57] ABSTRACT

A luggage lock for locking together the two shells of a luggage case. The lock includes a housing adapted to be mounted in one of the luggage case shells and which is secured to the shell by a threaded cap. A hook member is adapted to be mounted in the other one of the luggage case shells. A button is reciprocally mounted in the housing for movement between retracted and projected positions. A spring is positioned between the button and the cap to bias the button to its outward retracted position. The button includes a locking edge portion which projects into the path of travel of the hook when the case is closed whereby the hook end engages and overlies the locking edge to fasten the lock. The lock is unfastened by displacing the button to its projected position, against the action of the spring, to disengage the hook end from the locking edge to permit the case to be opened.

6 Claims, 5 Drawing Figures

LUGGAGE LOCK

BACKGROUND OF THE INVENTION

This invention relates to a luggage lock, particularly to a lock mostly used as an auxiliary lock of luggage combination lock. Various kinds of lock have been utilized in this purpose. However, most of them have complex structures and are easily broken down.

The principal object of the present invention is to provide a luggage lock having simple structure and minimum components, but still remain good function of the lock.

Another object of the present invention is to provide a luggage lock which is novel and completely different from the conventional ones. The difference includes not only the structure but also its outlook and its features.

Furthermore, another object of the present invention is to provide a luggage lock having lower cost than conventional ones and which may be assembled on the luggage case or attache case very conveniently and quickly.

These and other objects and features of this invention will be better understood and appreciated from the following detailed description of one embodiment thereof, selected for purposes of illustration and shown in the accompanying drawings.

DETAILED DESCRIPTION OF THE INVENTION

Figure 1:
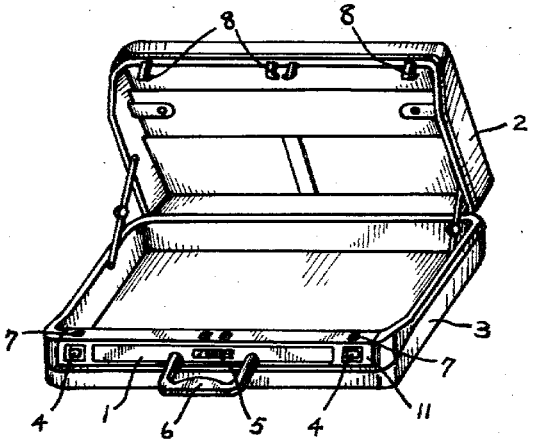
FIG. 1 is a perspective view showing an opened luggage case containing one conventional combination lock and two button-locks of the present invention in the front frame fixed on the front wall of the lower shell thereof.

As shown in FIG. 1 the luggage button-lock 4 of the present invention is secured in the front frame 11 fixed on the front wall of the lower shell 3 of a luggage case or attache case. The central portion of the front frame 11 has a conventional combination lock 5 and a handle 6 connected thereon. Adjacent to each end of the front frame 11, there is a button-lock 4 of the present invention. The top side of the front frame 11 has four holes 7 located just above the both button-locks 4 and the central combination lock 5. The upper shell 2 of the case contains four hooks 8 on the edge of its front wall. Each of the hooks 8 is directed to a hook-hole 7 and may be inserted into the hole when the upper shell 2 of the case is closed on the lower shell 3. The central hooks are controlled by the combination lock 5, and the two hooks on both ends are controlled by the two button-locks 4 adjacent to both ends of the front frame 11 fixed on the front wall of the lower shell 3.

Figure 2:
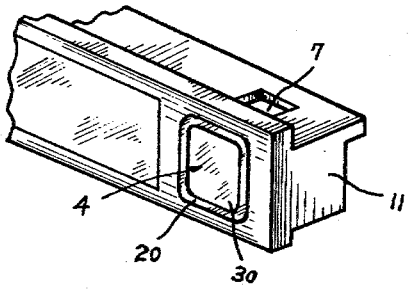
FIG. 2 is a perspective view showing a portion of the front frame containing a button-lock of the present invention.
Figure 3:
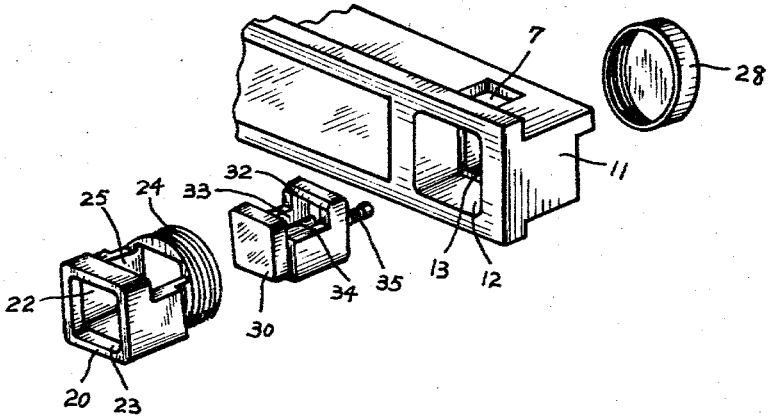
FIG. 3 is a perspective view showing the decomposed parts of a button-lock of the present invention.

As shown in FIGS. 2 and 3, the button-lock 4 of the present invention is secured in the lock-hole 12 on the front frame 11. The lock-hole 12 extends from the front side of the frame 11 to the rear side, and the rear end of the hole 12 has an inwardly projecting shoulder section 13. Above the lock-hole 12, the top side of the front frame 11 has a hook-hole 7 which connects with the lock-hole 12 downwardly.

Figure 4:
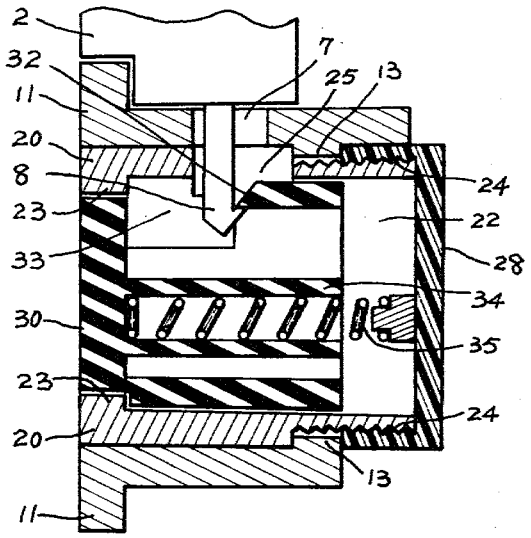
FIG. 4 is a section view showing the present button-lock in locking condition.

The present button-lock 4 comprises a housing 20, a button member 30, a spring 35 and a fastening cap 28. The outer surface of the housing 20 has a front section and a rear section interconnected by a body wall. The shape and length of the front section 22 conform to the front section of the lock-hole 12 and, the rear section 24 of the housing 20 has a cylindrical outer surface having screw threads thereon. An opening extends from front section 22 through rear section 24. A hook-hole 25 conforming with the hook-hole 7 on the front frame 11 is formed on the top body wall portion of the housing 20 and interconnects with the through-opening of said housing. As shown in FIG. 4, the housing 20 can be inserted into the lock-hole 12 from the front end of the hole 12 and fastened thereon by means of a fastening cap 28 having screw threads conforming to the threads on rear section 24 of the housing 20. A shoulder is formed in the housing wall adjacent the rear section 24 of the housing. When the fastening cap 28 is screwed on the rear section 24 of the housing 20, both of the fastening cap 28 and the housing 20 clamp the projecting shoulder section 13 of the lock-hole 12 on opposite sides thereof. The housing 20, therefore, is secured in the lock-hole 12 tightly.

Before screwing the fastening cap 28 on the rear section 24 of the housing 20, a button member 30 should be inserted into the housing 20 from its rear end to the front end. The button member 30 has a front finger engaging portion and a body wall extending rearwardly thereof. The outer surface of button member 30 conforms to the interior surface of the housing 20 so that the button member 30 may be moved back or forth in the housing 20. That is, the button member 30 may be considered as being disposed for reciprocal movement within housing 20 between a retracted position as shown in FIG. 4 and a projected position or shown in FIG. 5. The interior surface of the housing 20 has a recessed front edge or shoulder 23, while the outer surface of the button member 30 has an outwardly projecting front edge section, so that the button member 30 will not slip out of the front end of the housing 20. The button member 30 also has a hook-hole 33 on its top body wall, but the rear edge 32 of the hook-hole 33 extends considerably forward of the rear edge of the hole 25 of the housing 20 when the button member is in its foremost or retracted position. The arrangement is such as to locate the rear edge 32 of hook-hole 33 in the path of travel of the hook 8 of upper shell 2. The rear edge 32 of the hook-hole 33 has a sloping top side which enables the hook 8 of the upper shell 2 to slip into the hook-hole 33 smoothly. That is, the portion of the button body wall defining the rear edge 32 of said hook-hole 33 is inclined downwardly toward the front finger engaging portion of the button. In the button member 30, there is a tube or inner recess 34 for holding a spring 35 which is fixed between the button member 30 and the fastening cap 28. Due to the tension of the spring 35, the button member 30 is always pushed to its foremost or retracted position when no other pressure is provided on the button member 30. In such position, the finger engaging portion of button member 30 is located substantially flush with the front end portion 22 of housing 20, as shown in FIG. 4.

Figure 5:
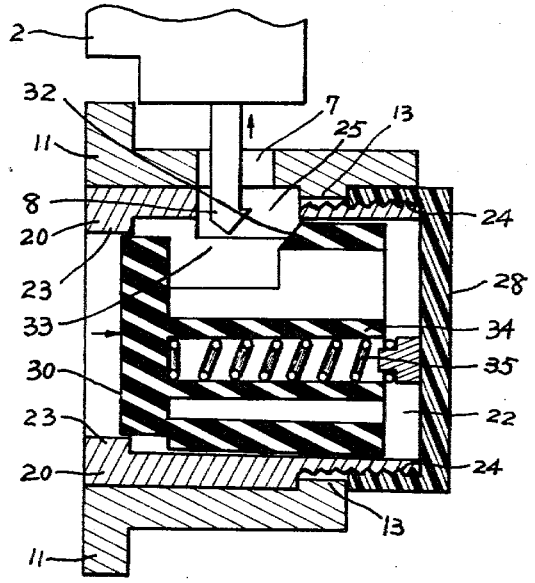
FIG. 5 is a section view showing the present button-lock in unlocking condition.

When a pressure is provided to the button member 30 against the tension of the spring 35, the button member 30 with the lockage edge 32 is moved backwardly for a distance to its projected position and releases the hook 8 as shown in FIG. 5. Thus, the upper shell 2 of the luggage case may be opened. Reversely, when the upper shell 2 is closed and pressed on the lower shell 3, the hook 8 is inserted into aligned the hook-holes 7, 25, and engages the sloping top side of the locking edge 32 to move the button member 30 backwardly to its projected position to permit the hook 8 to slip into the similarly aligned hook-hole 33. After the hook end passes the locking edge 32, the button member 30 returns to its original position by the tension of the spring 35 whereby the hook end engages and overlies the locking edge 32 to fasten the lock.

From the foregoing description it will be appreciated that the housing and the button member may have a shape of their front sections other than those illustrated in the above-mentioned drawings and still be utilized in the present invention. However, the rear section of the housing should have a cylindrical outer surface having screw threads thereon for fitting a fastening cap.

Having described this invention in detail, those skilled in the art will appreciate that numerous modifications may be made thereof without departing from the spirit of this invention. Therefore, it is not intended that the breadth of this invention be limited to the specific embodiment illustrated and described. Rather, it is intended that the scope of this invention be determined by the appended claims and their equivalents.

What is claimed is:

1. A luggage lock for locking together the two shells of a luggage case, said lock comprising:

(a) a housing having a front end portion, a rear end portion and a body wall interconnecting said front and rear end portions; said housing formed having a first opening extending from said front end portion to said rear end portion, and a second opening forming in said body wall and interconnecting with said first opening; said housing adapted to be received within an opening in one of the luggage case shells;

(b) closure means removably mounted on the rear end portion of said housing when the housing is positioned in the luggage case shell for securing said housing in its mounted position;

(c) a button member reciprocally mounted within said housing for movement between a retracted position and a projected position; said button having a front finger engaging portion and a body wall; and said body wall formed having an opening aligned with the body wall opening of the housing when the button is mounted therein;

(d) a spring member extending between said button member and said closure means for urging said button in the direction of the retracted position thereof;

(e) a hook adapted to be mounted on the other one of the luggage case shells and positioned with its hook end projecting through the aligned openings in said housing and said button body walls when the luggage case is closed; and (f) a portion of the button body wall defining the rear edge of said body wall opening projecting into the path of travel of said hook whereby said hook end engages and overlies said edge portion when the luggage case is closed to fasten said lock, and wherein said lock is unfastened by displacing said button to its projected position, against the action of said spring, to disengage said hook end from said edge portion to permit the luggage case to be opened.

2. The luggage lock as recited in claim 1, wherein said closure means comprises a cap formed with a collar having internal threads; the rear end portion of said housing formed having conformed outer threads whereby said cap is screwed on to said housing.

3. The luggage lock as recited in claim 1 or 2 further comprising interengaging means on said housing and said button member for locating said finger engaging button portion flush with said front end portion of said housing when said button member is in its retracted position.

4. The luggage lock as recited in claim 3, wherein said interengaging means comprises a recessed shoulder formed in the body wall portion of said housing and an outwardly projecting edge formed in the body wall protion of said button, said edge abutting against said shoulder when said button is biased to its retracted position under influence of said spring to prevent movement of said button outwardly of said housing through the front end portion thereof.

5. The luggage lock as recited in claim 1, wherein said button wall edge portion is inclined downwardly toward the front finger engaging portion of said button.

6. The luggage lock as recited in claim 1, wherein said button is formed having an inner recess for receiving and confining one end of said spring.

* * * * *